US011019981B2

(12) United States Patent
Welch

(10) Patent No.: US 11,019,981 B2
(45) **Date of Patent: *Jun. 1, 2021**

(54) DISHWASHER WITH ROTATIONALLY MOUNTED SPRAYER

(71) Applicant: Whirlpool Corporation, Benton Harbor, MI (US)

(72) Inventor: Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/008,833

(22) Filed: Sep. 1, 2020

(65) Prior Publication Data

US 2020/0390312 A1 Dec. 17, 2020

Related U.S. Application Data

(60) Continuation of application No. 16/856,083, filed on Apr. 23, 2020, now Pat. No. 10,820,780, which is a division of application No. 13/928,787, filed on Jun. 27, 2013, now Pat. No. 10,667,668.

(51) Int. Cl.
*A47L 15/42* (2006.01)
*A47L 15/23* (2006.01)

(52) U.S. Cl.
CPC ..... *A47L 15/4282* (2013.01); *A47L 15/23* (2013.01)

(58) Field of Classification Search
CPC ..... A47L 15/23; A47L 15/4282
See application file for complete search history.

(56) References Cited

U.S. PATENT DOCUMENTS

| | | | | |
|---|---|---|---|---|
| 3,468,486 | A | 9/1969 | Mercer | |
| 3,677,473 | A | 7/1972 | Belaieff | |
| 3,709,236 | A | 1/1973 | Field et al. | |
| 5,464,482 | A | 11/1995 | Michael et al. | |
| 5,477,874 | A | 12/1995 | Yura et al. | |
| 5,542,443 | A | 8/1996 | Yura et al. | |
| 5,944,037 | A | 8/1999 | Sinyong et al. | |
| 6,263,888 | B1 | 7/2001 | Nomura et al. | |
| 10,667,668 | B2 * | 6/2020 | Welch | A47L 15/4282 |
| 2012/0111380 | A1 | 5/2012 | Bayer et al. | |
| 2013/0074887 | A1 | 3/2013 | Feddema | |

FOREIGN PATENT DOCUMENTS

| | | | |
|---|---|---|---|
| DE | 6907663 | U | 11/1969 |
| DE | 4416655 | A1 | 11/1995 |
| EP | 1050263 | A2 | 11/2000 |
| EP | 1090579 | A1 | 4/2001 |
| EP | 1132039 | A2 | 9/2001 |
| EP | 1510168 | A2 | 3/2005 |
| EP | 1634526 | A2 | 3/2006 |

(Continued)

*Primary Examiner* — Douglas Lee
(74) *Attorney, Agent, or Firm* — McGarry Bair PC

(57) ABSTRACT

A dishwasher has a treating chamber with four corners and a rotatable sprayer located within the treating chamber, where the sprayer includes two conduit segments which rotate about two different axes and a spray head which rotates about yet another axis. The combined rotation of the conduit segments moves the spray head in a non-circular path around the treating chamber.

20 Claims, 6 Drawing Sheets

(56) References Cited

FOREIGN PATENT DOCUMENTS

| | | | |
|---|---|---|---|
| EP | 2294962 | A1 | 3/2011 |
| EP | 2389851 | A1 | 11/2011 |
| EP | 2389852 | A1 | 11/2011 |
| EP | 2545838 | A1 | 1/2013 |
| GB | 550511 | | 1/1943 |
| GB | 551349 | | 2/1943 |
| GB | 1286820 | | 8/1972 |
| JP | 5184514 | A | 7/1993 |
| JP | 2012110410 | A | 6/2012 |
| KR | 19970064554 | A | 10/1997 |
| KR | 20060029567 | A | 4/2006 |

* cited by examiner

DISHWASHER WITH ROTATIONALLY MOUNTED SPRAYER

CROSS-REFERENCE TO RELATED APPLICATION(S)

This application is a continuation of U.S. application Ser. No. 16/856,083, filed Apr. 23, 2020, now issued as U.S. Pat. No. 10,820,780, which is a divisional of U.S. application Ser. No. 13/928,787, filed Jun. 27, 2013, now issued as U.S. Pat. No. 10,667,668, both of which are incorporated by reference herein in their entirety.

BACKGROUND

Contemporary automatic dishwashers for use in a typical household include a tub and at least one rack or basket for supporting soiled dishes within the tub. A spraying system may be provided for recirculating liquid throughout the tub to remove soils from the dishes. The spraying system may include various sprayers including a rotatable sprayer.

BRIEF DESCRIPTION

The present disclosure relates to a dishwasher for treating dishes according to an automatic cycle of operation. The dishwasher has a tub at least partially defining a treating chamber with four corners and a sidewall, a recirculation system fluidly coupling at least two portions of the tub; and a sprayer fluidly coupled to the recirculation system and located within the treating chamber. The sprayer has a first conduit segment rotationally mounted relative to the tub for rotation about a first axis, a second conduit segment rotationally mounted to the first conduit segment at a location radially spaced from the first axis for rotation about a second axis, a spray head rotationally mounted to the second conduit segment at a location radially spaced from the second axis for rotation about a third axis, a drive link coupling the rotation of the spray head with the rotation of the first and second conduit segments; and a driver coupled to and moving one of the spray head, the first conduit segment, and the second conduit segment, thereby simultaneously rotating the spray head, the first conduit segment, and the second conduit segment. The first conduit segment and second conduit segment are axially aligned and the sprayer has an extended length when the spray head is at one of the four corners and the second conduit segment overlaps the first conduit segment and the sprayer has a retracted length when the spray head is adjacent the sidewall of the treating chamber. The spray head traverses a path having an outer boundary defining a squircle with four rounded corners corresponding to the four corners of the treating chamber Another aspect of the present disclosure is a dishwasher for treating dishes according to an automatic cycle of operation. The dishwasher has a tub at least partially defining a treating chamber with four corners; a recirculation system fluidly coupling at least two portions of the tub; and a sprayer fluidly coupled to the recirculation system and located within the treating chamber. The sprayer has a first arm rotationally mounted to the tub such that the first arm rotates about a first axis, a second arm rotationally mounted to the first arm, at a location radially spaced from the first axis, such that the second arm rotates about a second axis, a spray head rotationally mounted to the second arm at a location radially spaced from the second axis, such that the spray head rotates about a third axis; a drive link coupling the rotation of the spray head with the rotation of the first and second arms; and a driver coupled to and moving one of the spray head, the first arm, and the second arm, thereby simultaneously rotating the spray head, the first arm, and the second arm. As first arm is rotated about the first axis, the second axis of the second arm is translated about the treating chamber along a first path. As the second arm is rotated about the second axis, the spray head moves along a second path with respect to the second arm. As the spray head is rotated about the third axis, the compounded rotation of the first arm and second arm translates the third axis of the spray head along a third path in the treating chamber.

DETAILED DESCRIPTION

Figure 1:
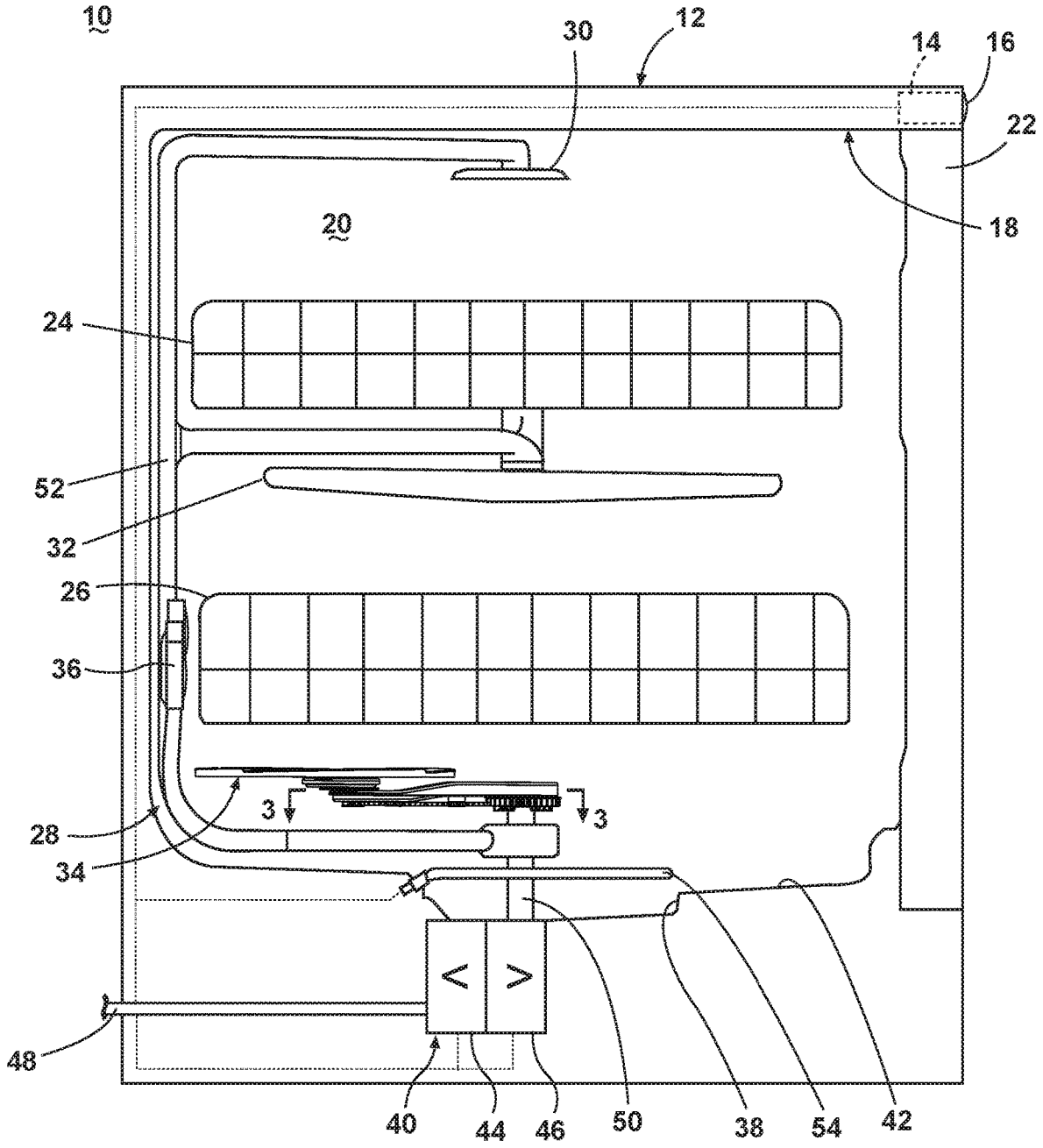
FIG. 1 is a schematic, cross-sectional view of a dishwasher with a spray system according to one aspect of the present disclosure.

In FIG. 1, an automated dishwasher 10 according to one aspect of the present disclosure is illustrated. The dishwasher 10 can treat dishes according to an automatic cycle of operation. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present disclosure is described in terms of a conventional dishwashing unit, it could also be implemented in other types of dishwashing units, such as in-sink dishwashers, multi-tub dishwashers, or drawer-type dishwashers.

A controller 14 may be located within the cabinet 12 and may be operably coupled with various components of the dishwasher 10 to implement one or more cycles of operation. A control panel or user interface 16 may be provided on the dishwasher 10 and coupled with the controller 14. The user interface 16 may include operational controls such as dials, lights, switches, and displays enabling a user to input commands, such as a cycle of operation, to the controller 14 and receive information.

A tub 18 is located within the cabinet 12 and at least partially defines a treating chamber 20 with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Dish holders in the form of upper and lower racks 24, 26 are located within the treating chamber 20 and receive dishes for being treated. The racks 24, 26 are mounted for slidable movement in and out of the treating chamber 20 for ease of loading and unloading. As used in this description, the term "dish(es)" is intended to be generic to any item, single or plural, that may be treated in the dishwasher 10, including, without limitation; utensils, plates, pots, bowls, pans, glassware, and silverware. While not shown, additional utensil holders, such as a silverware basket on the interior of the door 22, may also be provided.

A spraying system 28 may be provided for spraying liquid into the treating chamber 20 and is illustrated in the form of an upper sprayer 30, a mid-level rotatable sprayer 32, a lower rotatable sprayer 34, and a spray manifold 36. The upper sprayer 30 may be located above the upper rack 24 and is illustrated as a fixed spray nozzle that sprays liquid downwardly within the treating chamber 20. The mid-level rotatable sprayer 32 is located between the upper rack 24 and the lower rack 26 and is illustrated as a rotating spray arm. The mid-level spray arm 32 may provide a liquid spray upwardly through the bottom of the upper rack 24. The mid-level rotatable sprayer 32 may optionally also provide a liquid spray downwardly onto the lower rack 26, but for purposes of simplification, this will not be illustrated herein. The lower rotatable sprayer 34 is located underneath the lower rack 26 and may provide a liquid spray upwardly through the bottom of the lower rack 26.

The spray manifold 36 may be fixedly mounted to the tub 18 adjacent to the lower rack 26 and may provide a liquid spray laterally through a side of the lower rack 26. The spray manifold 36 may not be limited to this position; rather, the spray manifold 36 may be located in virtually any part of the treating chamber 20. While not illustrated herein, the spray manifold 36 may include multiple spray nozzles having apertures configured to spray wash liquid towards the lower rack 26. The spray nozzles may be fixed or rotatable with respect to the tub 18.

A liquid recirculation system may be provided for recirculating liquid from the treating chamber 20 to the spraying system 28. The recirculation system may include a sump 38 and a pump assembly 40. The sump 38 collects the liquid sprayed in the treating chamber 20 and may be formed by a sloped or recessed portion of a bottom wall 42 of the tub 18. The pump assembly 40 may include both a drain pump 44 and a recirculation pump 46.

The drain pump 44 may draw liquid from the sump 38 and pump the liquid out of the dishwasher 10 to a household drain line 48. The recirculation pump 46 may draw liquid from the sump 38 and pump the liquid to the spraying system 28 to supply liquid into the treating chamber 20. While the pump assembly 40 is illustrated as having separate drain and recirculation pumps 44, 46 in an alternative example, the pump assembly 40 may include a single pump configured to selectively supply wash liquid to either the spraying system 28 or the drain line 48, such as by configuring the pump to rotate in opposite directions, or by providing a suitable valve system. While not shown, a liquid supply system may include a water supply conduit coupled with a household water supply for supplying water to the sump 38.

As shown herein, the recirculation pump 46 has an outlet conduit 50 in fluid communication with the spraying system 28 for discharging wash liquid from the recirculation pump 46 to the sprayers 30-36. As illustrated, liquid may be supplied to the spray manifold 36, mid-level rotatable sprayer 32, and upper sprayer 30 through a supply tube 52 that extends generally rearward from the recirculation pump 46 and upwardly along a rear wall of the tub 18. While the supply tube 52 ultimately supplies liquid to the spray manifold 36, mid-level rotatable sprayer 32, and upper sprayer 30, it may fluidly communicate with one or more manifold tubes that directly transport liquid to the spray manifold 36, mid-level rotatable sprayer 32, and upper sprayer 30. Further, diverters (not shown) may be provided within the spraying system 28 such that liquid may be selectively supplied to each of the sprayers 30-36. The sprayers 30-36 spray water and/or treating chemistry onto the dish racks 24, 26 (and hence any dishes positioned thereon) to effect a recirculation of the liquid from the treating chamber 20 to the liquid spraying system 28 to define a recirculation flow path.

A heating system having a heater 54 may be located within or near the sump 38 for heating liquid contained in the sump 38. A filtering system (not shown) may be fluidly coupled with the recirculation flow path for filtering the recirculated liquid.

Figure 2:
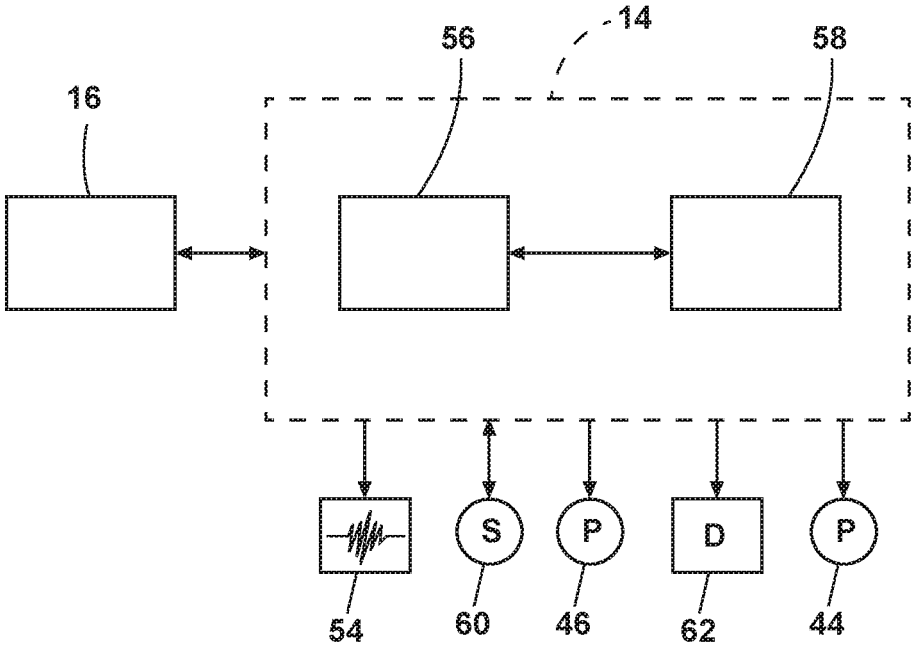
FIG. 2 is a schematic view of a control system of the dishwasher of FIG. 1.

As illustrated in FIG. 2, the controller 14 may be provided with a memory 56 and a central processing unit (CPU) 58. The memory 56 may be used for storing control software that may be executed by the CPU 58 in completing a cycle of operation using the dishwasher 10 and any additional software. For example, the memory 56 may store one or more pre-programmed cycles of operation that may be selected by a user and completed by the dishwasher 10. A cycle of operation for the dishwasher 10 may include one or more of the following steps: a wash step, a rinse step, and a drying step. The wash step may further include a pre-wash step and a main wash step. The rinse step may also include multiple steps such as one or more additional rinsing steps performed in addition to a first rinsing. The amounts of water and/or rinse aid used during each of the multiple rinse steps may be varied. The drying step may have a non-heated drying step (so called "air only"), a heated drying step or a combination thereof. These multiple steps may also be performed by the dishwasher 10 in any desired combination.

The controller 14 may be operably coupled with one or more components of the dishwasher 10 for communicating with and controlling the operation of the components to complete a cycle of operation. For example, the controller 14 may be coupled with the recirculation pump 46 for circulation of liquid in the tub 18 and the drain pump 44 for drainage of liquid in the tub 18. The controller 14 may also be operably coupled to the heater 54. Further, the controller 14 may also be coupled with one or more optional sensors 60. Non-limiting examples of optional sensors 60 that may be communicably coupled with the controller 14 include a moisture sensor, a door sensor, a temperature sensor, a detergent and rinse aid presence/type sensor(s). The controller 14 may also be coupled to a dispenser 62, which may dispense a detergent during the wash step of the cycle of operation or a rinse aid during the rinse step of the cycle of operation.

Figure 3:
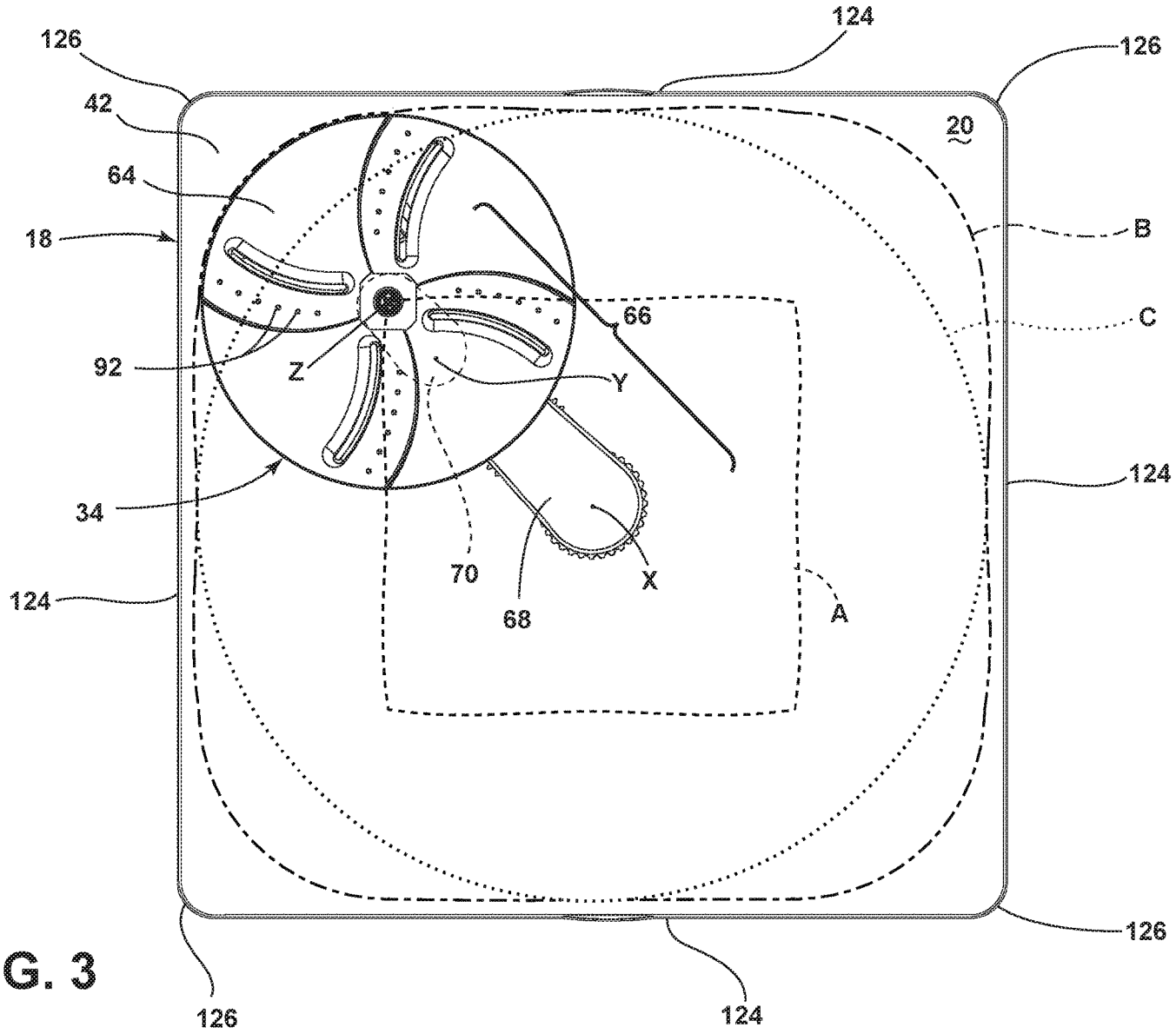
FIG. 3 is a top view of a rotatable sprayer of the spray system of the dishwasher from FIG. 1, illustrating the path of travel of the rotatable sprayer.

FIG. 3 is a top view of the rotatable sprayer 34 and tub 18. The sprayer 34 includes a spray head 64 and a conduit 66 that fluidly couples the spray head 64 to the recirculation system. The conduit 66 can include a first conduit segment 68 rotationally mounted relative to the tub 18 for rotation about a first axis X and a second conduit 70 segment rotationally mounted to the first conduit segment 68 at a location radially spaced from the first axis X for rotation about a second axis Y. The spray head 64 can be rotationally mounted to the second conduit segment 70 at a location radially spaced from the second axis Y for rotation about a third axis Z. The first and second conduit segments 68, 70 are shown herein as first and second arms, respectively, that each rotate about distinct axes X, Y.

Figure 4:
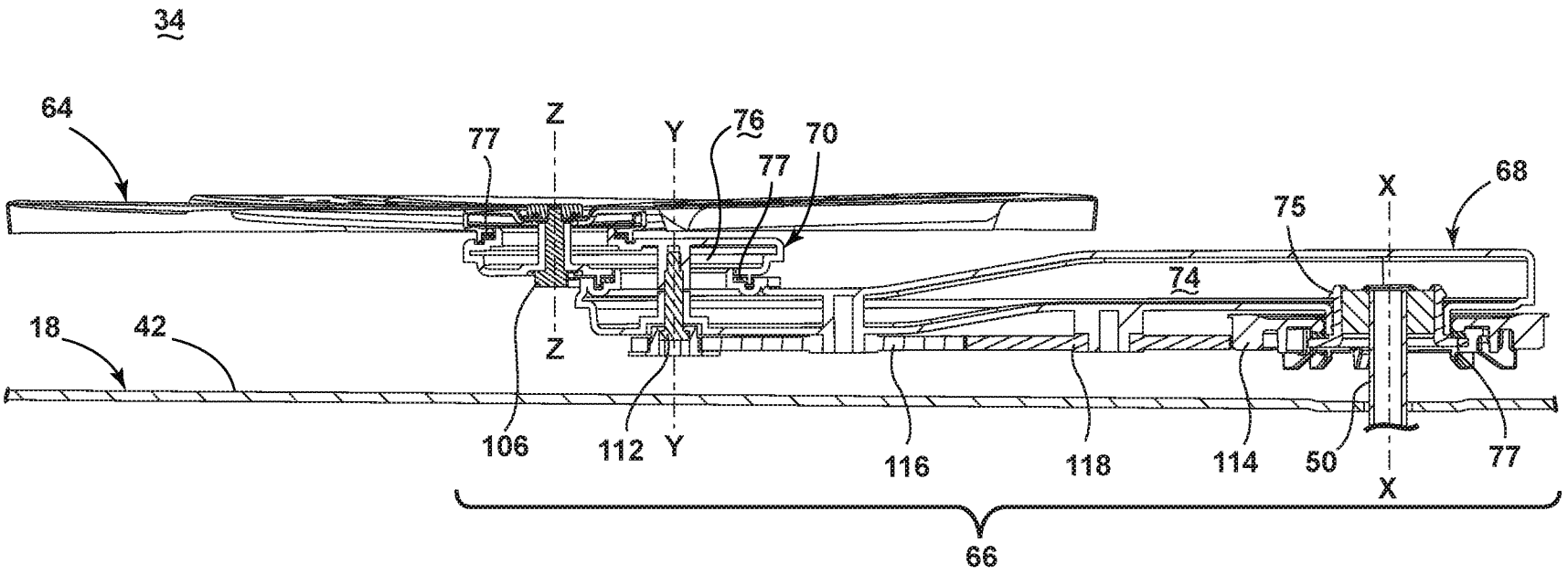
FIG. 4 is a cross-sectional view of the rotatable sprayer from FIG. 3.

FIG. 4 is a cross-sectional view of the lower rotatable sprayer 34 from FIG. 3. The conduit 66 defines a fluid path 72 extending through the first and second arms 68, 70 from the recirculation system to the spray head 64, wherein the first arm 68 is fluidly coupled to the recirculation system and the second arm 70 is fluidly coupled to the spray head 64. The arms 68, 70 may be at least partially hollow to define the fluid path 72, with the first arm 68 defining an interior chamber 74 that fluidly communicates with an interior chamber 76 defined by the second arm 70. The outlet conduit 50 is fluidly coupled to the first interior chamber 74 of the first arm 68 by a coupler 75, which can releasably mount the first arm 68 to the outlet conduit 50, such as via a bayonet-type mount. Seal rings 77 can be provided between the coupler 75 and the underside of the first arm 68, between the top side of the first arm 68, the underside of the second arm 70, and between the top side of the second arm 70 and the underside of the spray head 64 to ensure a fluid-tight connection between the moving parts of the rotatable sprayer 34.

Figure 5:
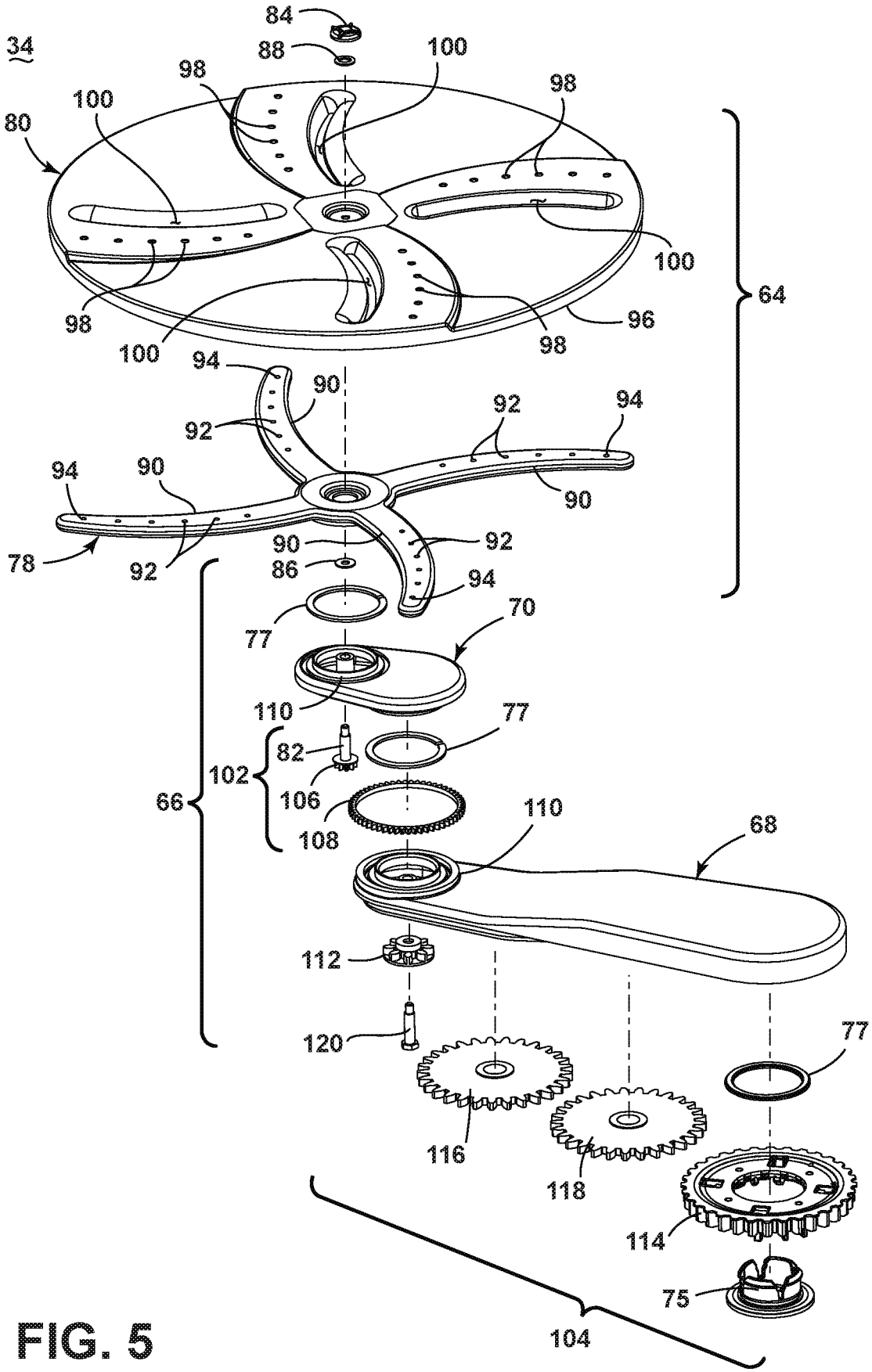
FIG. 5 is an exploded view of the rotatable sprayer from FIG. 3.

FIG. 5 is an exploded view of the rotatable sprayer 34 from FIG. 3. The spray head 64 can include a spray body 78 and a spray cover 80 received on top of the spray body 78. The spray body 78 can be supported by the second arm 70, and the spray cover 80 can be supported by the spray body 78, with the second arm 70, spray body 78, and spray cover 80 held together by a fastener assembly, such as shaft 82 which extends through the second arm 70, spray body 78, and spray cover 80 and nut 84 which attaches to the shaft 82 at the top of the spray cover 80. The fastener assembly further includes a washer 86 located between a top side of the second arm 70 and the underside of the spray cover 80. A slip ring 88 can be located between the top side of the spray cover 80 and the underside of the nut 84.

The spray body 78 can be X-shaped, with four radially extending arms 90, each of which is provided with one or more outlet nozzles 92 for spraying liquid. The outlet nozzles 92 can be oriented in the same or in a plurality of different directions such that the spray from the outlet nozzles 92 is projected at the same or in a plurality of different angles. At least one of the outlet nozzles 92 can be drive nozzles 94, such that the rotation of the spray head 64 is driven by the spray from the drive nozzles 94. As shown herein, the outermost nozzle on each arm 90 can be configured as a drive nozzle 94.

The spray cover 80 can be disc-shaped, with a substantially circular outer periphery 96 that extends downwardly over the arms 90 of the spray body 78, giving the spray head 64 an overall substantially circular outer periphery when viewed from above. The spray cover 80 includes one or more outlet passages 98 which are aligned with the one or more outlet nozzles 92 in the spray body 78 for spraying liquid. The spray cover 80 can further be provided with one or more openings 100, which allows liquid and soil to pass through the spray cover 80 and past the spray body 78, rather than accumulating on top of the spray head 64.

Alternatively, the spray cover 80 of the spray head 64 can be eliminated, such that only the spray body 78 with the X-shaped profile remains as the spray head 64. In still another configuration, the spray cover 80 can be eliminated and the spray body 78 itself can be disc-shaped. Configurations other than circular and X-shaped are also possible.

A driver is coupled to and moves one of the spray head 64, the first arm 68, and the second arm 70, thereby simultaneously rotating the spray head 64, the first arm 68, and the second arm 70. As shown herein the driver can include the drive nozzles 94 provided on the spray head 64 and the recirculation pump 46 (FIG. 1) to which the drive nozzles 94 are fluidly coupled, such that the rotation of the sprayer 34 is driven by the spray from the drive nozzles 94. Other examples of drivers include a motor.

A drive link couples the rotation of the spray head 64 with the rotation of the first and second arm 68, 70. The drive link shown herein includes a first gear set 102 coupling the rotation of the second arm 70 with the rotation of the spray head 64 and a second gear set 104 coupling the rotation of the first arm 68 with the rotation of the second arm 70. The drive link may be another suitable linkage system including one or more gears, cranks, belts, or a combination thereof.

The first gear set 102 can include a pinion gear 106 coupled at the head of the shaft 82 connecting the second arm 70, spray body 78, and spray cover 80 together such that the movement of the spray head 64 rotates the pinion gear 106, and a spur gear 108 is fixed to one end of the first arm 68. The spur gear 108 is received on a collar 110 at one of the first arm 68, such that the spur gear 108 is fixed in place, with the pinion gear 106 progressing around the spur gear 108 as the spray head 64 rotates. As such, the spur gear 108 defines an orbital path for the spray head 64 with respect to the second arm 70.

The second gear set 104 can be a gear train which includes a drive gear 112 coupled with the second arm 70, a driven gear 114 carried on the first arm 68, and one or more intermediate gears 116, 118 coupling the drive gear 112 and the driven gear 114. The drive gear 112 can be a pinion gear coupled at one end of a shaft 120 holding the first and second arms 68, 70 together, such that the movement of the second arm 70 rotates the drive gear 112. The driven gear 114 can be received on the coupler 75 which mounts the first arm 68 to the outlet conduit 50 (FIG. 3).

Referring back to FIG. 3, the tub 18 includes four side walls 124 which extend upwardly from the bottom wall 42. One of the side walls 124 can be defined by the closed door 22 (FIG. 1) of the dishwasher 10. The side walls 124 meet at and define four corners 126 of the tub 18. While the tub 18 is shown herein as generally being square in shape with straight side walls 124 and corners 126 that are right angles, this is for illustrative purposes only, and the tub 18 can have other configurations. For example, the tub could be rectangular in shape, the side walls 124 could contain some irregularities, and or the corners 126 could be non-right angles or rounded.

The drive link can be configured such that the first arm 68 rotates at a lower revolutions per minute (RPM') than the second arm 70 and the spray head 64 rotates at a higher RPM than the first arm 68 and the second arm 70. In one example, the gear ratio of the first gear set 102 is 4:1 and the gear ratio of the second gear set 104 can be 6:1, which gives the spray head 64 a total mechanical advantage of 241. Thus, the spray head 64 will rotate 24 times faster than the first arm 68. With this mechanical advantage, if the first arm 68 rotates at 2.5 RPM, the spray head 64 will rotate at 60 RPM. Such a significant difference in the rotation speeds of the first arm 68 and the spray head 64 can allow the spray head to dwell in sections of the treating chamber 20 for longer periods of time and provide a localized, intense washing zone that moves slowly around the treating chamber 20.

The dimensions of the rotatable sprayer 34 can also affect the cleaning performance. The spray head 64 can be configure to have a diameter of a little less than half of the width of the treating chamber 20 in order to maximize spray coverage. In one example, the spray head 64 can have a diameter of approximately 236 mm. The first arm 68 can be longer than the second arm 70 so that the first arm 68 has a longer period of rotation than the second arm 70. In one example, the ratio of the length of the first arm 68 to the length of the second arm 70 is 6:1.

The third axis Z that passes through the center of the spray head 64 and the path A traversed by the center of the spray at the third axis Z comprises four corners corresponding to the four corners 126 of the treating chamber 20. The actual spray path of the spray head 64 is wider, since the outlet nozzles 92 extend radially outwardly with respect to the third axis Z. As such, the spray head 64 traverses a path B having an outer boundary defining a squircle with four rounded corners corresponding to the four corners 126 of the treating chamber 20. While the term squircle is commonly defined as a mathematical shape with properties between those of a square and a circle, and is a special case of a superellipse, as used herein, the term squircle is a shape that has qualities of both a square and a circle, and expressly includes a rounded square or squared circle. The path C of a typical center-mounted sprayer or wash arm is shown in FIG. 3 for comparison. As can be seen in FIG. 5, the rotatable sprayer 34 increases the amount of spray coverage in the corners 126 of the treating chamber 20 in comparison to a typical center-mounted sprayer or wash arm.

Figure 6:
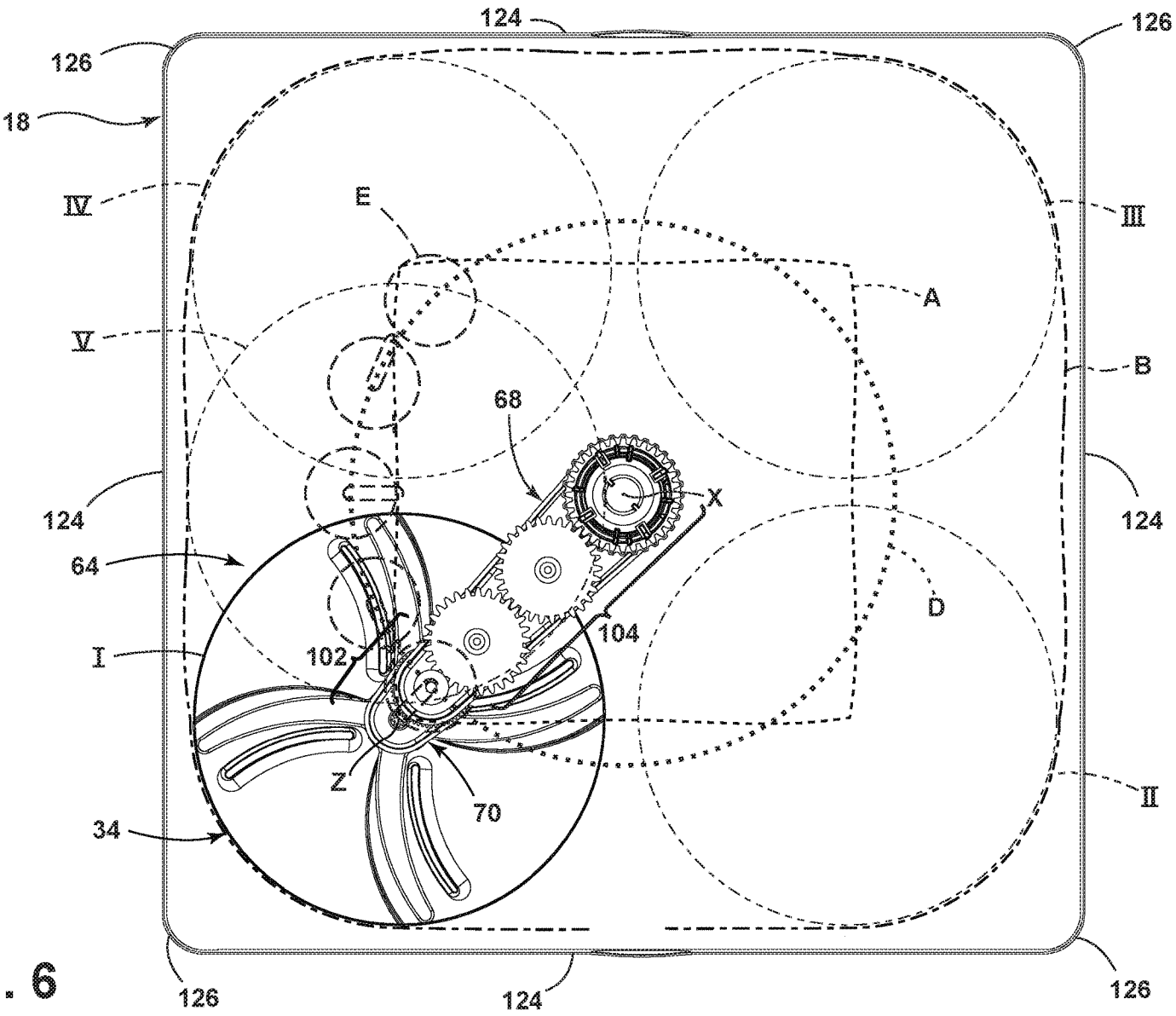
FIG. 6 is a bottom view of the rotatable sprayer from FIG. 3, illustrating the path of travel of the rotatable sprayer.

FIG. 6 is a bottom view of the rotatable sprayer 34 and tub 18, illustrating the path of travel of the rotatable sprayer 34 within the treating chamber 20. During operation, the rotatable sprayer 34 can be driven by spraying liquid from the drive nozzles 94 on the spray head 64. Liquid can be pumped to the nozzles by the recirculation pump 46 (FIG. 1), through the first and second arms 68, 70, to the spray head 64, and out of the drive nozzles 94. Liquid will also be sprayed out of the outlet nozzles 92.

As the first arm 68 is rotated about the first axis X, the second axis Y of the second arm 70 is translated about the treating chamber 20 in a path D having a generally circular route. As the second arm 70 is rotated about the second axis Y, the spray head 64 moves in an orbital path E with respect to the second arm 70 having a smaller circular route. However, the spray head 64 is not limited to the path E, because as the spray head 64 is rotated about the third axis Z, the compounded rotation of the first and second arms 68, 70 translates the third axis Z of the spray head 64 along path A. Path A has a generally rectangular route in the treating chamber 20, the rectangular route having four corners corresponding to the four corners 126 of the treating chamber 20 to provide a direct spraying in the four corners 126 of the treating chamber 20. More specifically, the spray head 64 can move along a generally square route, especially in the case when the tub 18 has a substantially square shape. The shape of the path A can be tailored to the shape of the tub 18, so that the spray from the spray head 64 can cover substantially the entire treating chamber 20.

Several exemplary positions of the spray head 64 are shown in FIG. 6, including the four positions I-IV in which the spray head 64 is located at the corners 126 of the treating chamber 20. In these positions, the first and second arms 68, 70 are axially aligned such that the rotatable sprayer 34 is at its maximum length. A fifth exemplary position V is also shown in FIG. 6, in which the spray head 64 is located at the center of one of the side walls 124 defining the treating chamber 20. In this position, the first and second arms 68, 70 are axially aligned, but the end of the second arm 70 coupled with the spray head 64 overlaps the first arm 68, such that the rotatable sprayer 34 is at its minimum length. In this way, the sprayer 34 and the drive link are configured to extend the spray head 64 into the corners 126 and retract the spray head 64 as it passes closer to the side walls 124 in a repeating, cyclical pattern.

There are several advantages of the present disclosure arising from the various features of the apparatuses described herein. For example, the aspect of the present disclosure described above allows for more complete spray coverage of the treating chamber using less water. For superior cleaning performance, it is best to flood the treating chamber with wash liquid. However, as less water is used in dishwashers in order to make them more energy efficient, this flooding action is harder to achieve. The rotatable sprayer 34 of the present disclosure solves this problem by flooding smaller sections of the treating chamber at a time, rather than trying to cover the entire treating chamber at one time. The rotatable sprayer 34 of the present disclosure effectively dwells the spray head 64 at different locations by slowing the rotation of the first arm 68, such that the first arm 68 rotates much slower than the spray head 64.

Another advantage is that the aspect of the present disclosure described above allows for better corner cleaning. Typical dishwashers employ sprayers that rotate in a circular path, and since the treating chambers are typically rectangular or square, the corners of the treating chamber may not experience as much spray action at the center. The rotatable sprayer 34 of the present disclosure solves this problem by mounting the spray head 64 on two rotating arms 68, 70 such that the compounded rotation of the first and second arms 68, 70 translates the spray head 64 into the corners of the treating chamber, but also pulls the spray head 64 back to clear the side walls of the treating chamber.

While the present disclosure has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher for treating dishes according to an automatic cycle of operation, comprising:

a tub at least partially defining a treating chamber with four corners and a sidewall;

a recirculation system fluidly coupling at least two portions of the tub; and a sprayer fluidly coupled to the recirculation system and located within the treating chamber, with the sprayer comprising:

a first conduit segment rotationally mounted relative to the tub for rotation about a first axis;

a second conduit segment rotationally mounted to the first conduit segment at a location radially spaced from the first axis for rotation about a second axis;

a spray head rotationally mounted to the second conduit segment at a location radially spaced from the second axis for rotation about a third axis;

a drive link coupling the rotation of the spray head with the rotation of the first and second conduit segments; and a driver coupled to and moving one of the spray head, the first conduit segment, and the second conduit segment, thereby simultaneously rotating the spray head, the first conduit segment, and the second conduit segment such that the first conduit segment and second conduit segment are axially aligned and the sprayer has an extended length when the spray head is at one of the four corners and the second conduit segment overlaps the first conduit segment and the sprayer has a retracted length when the spray head is adjacent the sidewall of the treating chamber such that the spray head traverses a path having an outer boundary defining a squircle with four rounded corners corresponding to the four corners of the treating chamber.

2. The dishwasher of claim 1, wherein the first and second conduit segments comprise first and second arms.

3. The dishwasher of claim 2, wherein the spray head comprises a disc-shaped spray head.

4. The dishwasher of claim 3, wherein the spray head comprises a plurality of outlet nozzles, wherein at least some of the outlet nozzles comprise drive nozzles, such that the rotation of the spray head is driven by the spray from the drive nozzles.

5. The dishwasher of claim 1, wherein the first conduit segment is longer than the second conduit segment.

6. The dishwasher of claim 5, wherein the ratio of the length of the first conduit segment to the length of the second conduit segment is 6:1.

7. The dishwasher of claim 1 and further comprising a fluid path extending through the first and second conduit segments from the recirculation system to the spray head, wherein the first conduit segment is fluidly coupled to the recirculation system and the second conduit segment is fluidly coupled to the spray head.

8. The dishwasher of claim 1, wherein the driver comprises a pump and at least one drive nozzle provided on the spray head and fluidly coupled to the pump, such that the rotation of the spray head is driven by the spray from the at least one drive nozzle.

9. The dishwasher of claim 8, wherein the drive link comprises a first gear set coupling the rotation of the second conduit segment with the rotation of the spray head and a second gear set coupling the rotation of the first conduit segment with the rotation of the second conduit segment.

10. The dishwasher of claim 9, wherein the gear ratio of the first gear set is 4:1 and the gear ratio of the second gear set is 6:1.

11. The dishwasher of claim 9 wherein a gear ratio of the first gear set and the second gear set causes the spray head to rotate over twenty times faster than the first conduit segment and allows the spray head to dwell in sections of the treating chamber.

12. The dishwasher of claim 1, wherein the drive link is configured such that the first conduit segment rotates at a lower RPM than the second conduit segment and the spray head rotates at a higher RPM than the first conduit segment and the second conduit segment.

13. The dishwasher of claim 1, wherein the third axis passes through a center of the spray head and the path traversed by the center of the spray at the third axis comprises a square with four corners corresponding to the four corners of the treating chamber.

14. The dishwasher of claim 1 wherein the spray head overlies an entirety of a length of the second conduit segment.

15. A dishwasher for treating dishes according to an automatic cycle of operation, comprising:

a tub at least partially defining a treating chamber with four corners;

a recirculation system fluidly coupling at least two portions of the tub; and a sprayer fluidly coupled to the recirculation system and located within the treating chamber, with the sprayer comprises:

a first arm rotationally mounted to the tub such that the first arm rotates about a first axis;

a second arm rotationally mounted to the first arm, at a location radially spaced from the first axis, such that the second arm rotates about a second axis;

spray head rotationally mounted to the second arm at a location radially spaced from the second axis, such that the spray head rotates about a third axis;

a drive link coupling the rotation of the spray head with the rotation of the first and second arms; and a driver coupled to and moving one of the spray head, the first arm, and the second arm, thereby simultaneously rotating the spray head, the first arm, and the second arm such that as the first arm is rotated about the first axis, the second axis of the second arm is translated about the treating chamber along a first path, and as the second arm is rotated about the second axis, the spray head moves along a second path with respect to the second arm, and as the spray head is rotated about the third axis, the compounded rotation of the first arm and second arm translates the third axis of the spray head along a third path in the treating chamber.

16. The dishwasher of claim 15 wherein the first path is a generally circular route.

17. The dishwasher of claim 15 wherein the second path is a generally circular route.

18. The dishwasher of claim 17 wherein the circular route of the second path is a smaller circular route than the circular path of the first circular route.

19. The dishwasher of claim 15 wherein the third path is a generally rectangular route.

20. The dishwasher of claim 19 wherein the rectangular route has four corners corresponding to the four corners of the dishwasher.

* * * * *